US006568231B1

(12) United States Patent
Huang

(10) Patent No.: US 6,568,231 B1
(45) Date of Patent: May 27, 2003

(54) LOCK STRUCTURE FOR BATHROOM USE

(75) Inventor: Chao-Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/173,687

(22) Filed: Jun. 18, 2002

(51) Int. Cl.[7] ..... E05B 55/04

(52) U.S. Cl. ..... 70/468; 292/358; 292/359; 70/472; 70/477; 70/489

(58) Field of Search ..... 292/357–359, 292/DIG. 24; 70/468, 462, 471, 472, 477, 479, 480, 481, 483, 489, 149

(56) References Cited

U.S. PATENT DOCUMENTS 1,528,515 A * 3/1925 Taylor ..... 70/121
2,244,238 A * 6/1941 Best ..... 292/356
2,370,645 A * 3/1945 Falk ..... 292/359
2,442,763 A * 6/1948 Falk ..... 70/211
2,577,216 A * 12/1951 Spinello ..... 292/173
2,620,646 A * 12/1952 McConnell ..... 70/211
4,809,526 A * 3/1989 Shen ..... 70/107
4,861,084 A * 8/1989 Ozagir et al. ..... 292/359
4,866,965 A * 9/1989 Urdal ..... 70/481
4,920,773 A * 5/1990 Surko, Jr. ..... 70/224
5,286,074 A * 2/1994 Lin ..... 292/336.3
5,484,177 A * 1/1996 Fortune et al. ..... 292/140
5,505,508 A * 4/1996 Kuo ..... 292/359
5,562,317 A * 10/1996 Kuo et al. ..... 292/359
5,636,882 A * 6/1997 Hook ..... 292/359
5,651,568 A * 7/1997 Fortune et al. ..... 292/140
5,826,924 A * 10/1998 Huang ..... 292/359
5,881,586 A * 3/1999 Shen ..... 70/107
6,178,795 B1 * 1/2001 Hsueh ..... 70/472
6,286,347 B1 * 9/2001 Frolov ..... 70/472

* cited by examiner

*Primary Examiner*—Anthony Knight
*Assistant Examiner*—John B. Walsh
(74) *Attorney, Agent, or Firm*—Bacon & Thomas, PLLC

(57) ABSTRACT

A lock structure for bathroom use comprises an outer rose, an inner rose, an outer unlatching mechanism mounted to the outer rose, and an inner unlatching mechanism mounted to the inner rose. The inner unlatching mechanism includes a turnable inner unlatching rod on which a locking wheel is mounted to turn therewith. The locking wheel includes an engaging block for selectively engaging with a first engaging notch and a second engaging notch in a fixing member securely mounted in the inner rose. When the engaging block is engaged in the second engaging notch of the fixing member, the locking wheel is engaged in a notch of a follower wheel mounted on an inner spindle. The follower wheel can be turned when the inner handle is turned such that rotation of the follower wheel returns the locking wheel, thereby achieving the unlatching operation.

7 Claims, 7 Drawing Sheets

LOCK STRUCTURE FOR BATHROOM USE

BACKGROUND OF THE INVENTION

1. Field of the Invention

The present invention relates to a lock structure for bathroom use.

2. Description of the Related Art

FIG. 8 of the drawings illustrates a conventional lock structure for bathroom use. The lock structure includes a latch mechanism 91 mounted into a doorplate 90 through an end face of the doorplate 90. An inner rose 92 is mounted to an inner side of the doorplate 90. An inner handle 93 is pivotally mounted to the inner rose 92 such that pivotal movement of the inner handle 93 causes retraction of a latch bolt 911 of the latch mechanism 91. A turn piece 96 is pivotally mounted to the inner rose 92, and turning of the turn piece 96 causes locking or unlocking. An outer rose 94 is mounted to an outer side of the doorplate 90. An outer handle 95 is pivotally mounted to the outer rose 94 such that pivotal movement of the outer handle 95 causes retraction of the latch bolt 911 of the latch mechanism 91.

Referring to FIG. 9, a disc 97 and a slide plate 98 are mounted in the inner rose 92. The disc 97 turns together with the inner handle 93 and includes a notch 971 in a top thereof. A portion of the turn piece 96 received in the inner rose 92 includes a diverging groove 961 having a guide pin 962 therein. An end of the guide pin 962 is pivotally engaged in a hole 981 of the slide plate 98. The slide plate 98 has a protrusion 982 on a lower end thereof. The slide plate 98 may slide in the inner rose 92 along a vertical direction, allowing the protrusion 982 to engage with or disengage from the notch 971 of the disc 97.

When it is desired to open the doorplate 90 from an inner side of the doorplate 90 in a locked state, the turn piece 96 is firstly turned to make the slide plate 98 slide upward in the inner rose 92, thereby disengaging the protrusion 982 from the notch 971 of the disc 97. Thus, either handle 93, 95 can be turned for opening the door. However, the door-unlocking action through turning the turn piece 96 and moving the slide plate 98 depends on the turning direction of the turn piece 96. Namely, the manufacturer must know the exact type of the door (a left-handed one or a right-handed one) to which the lock is to be mounted, and the customer must be aware of this fact to avoid wrong installation.

SUMMARY OF THE INVENTION

It is the primary object of the present invention to provide a lock structure that allows easy installation to a door, regardless of the type of the door.

It is another object of the present invention to provide a lock structure that can be easily unlocked from an inner side of the doorplate. Further, the lock can be easily unlatched by means of pressing of the inner handle.

A lock structure for bathroom use in accordance with the present invention includes an outer rose, an inner rose, an outer unlatching mechanism, and an inner unlatching mechanism. An outer handle is pivotally mounted to the outer rose. An outer spindle is connected to the outer handle to turn therewith. A wheel is mounted to the outer spindle to turn therewith and includes an engaging groove. A pair of plates is formed on the outer rose, and a hole is defined between the plates.

An inner handle is pivotally mounted to the inner rose. An inner spindle is connected to the inner handle to turn therewith. A drive wheel and a follower wheel are mounted on the inner spindle to turn therewith. An elastic element is mounted on the inner spindle for returning the inner handle. The follower wheel includes a notch. The inner rose further includes a hole.

The inner unlatching mechanism includes an inner unlatching rod, a fixing member, and a locking wheel. The inner unlatching rod is pivotally extended through the hole of the inner rose. The fixing member is fixed in the inner rose and includes a hole through which the inner unlatching rod extends. The fixing member further includes a first engaging notch and a second engaging notch shallower than the first engaging notch. The locking wheel is mounted on the inner unlatching rod to turn therewith. The locking wheel includes an engaging block and a plurality of teeth. When the engaging block is engaged in the first engaging notch of the fixing member, the locking wheel is disengaged from the follower wheel. When the engaging block is engaged in the second engaging notch of the fixing member, the locking wheel is engaged in the notch of the follower wheel.

The outer unlatching mechanism includes an outer unlatching rod, an elastic element, a stop plate, and a locking plate. The outer unlatching rod is pivotally extended through the hole of the outer rose and includes a first end securely engaged with the inner unlatching rod of the inner unlatching mechanism. The outer unlatching rod further includes a second end that is exposed outside the outer rose and that has a drive portion. The locking plate is mounted on the outer unlatching rod to turn therewith. The stop plate is mounted on the outer unlatching rod and rotatable relative to the locking plate. The locking plate includes a first engaging groove and a second engaging groove shallower than the first engaging groove. The stop plate includes a protrusion and is biased by the elastic element of the outer unlatching mechanism to be selectively engaged in one of the first engaging groove and the second engaging groove of the locking plate. When the protrusion of the stop plate is engaged in the first engaging groove of the locking plate, the stop plate is partially located between the plates on the outer rose and engaged in the engaging groove of the wheel. When the protrusion of the stop plate is engaged in the second engaging groove of the locking plate, the stop plate is received between the plates on the outer rose and disengaged from the engaging groove of the wheel.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

Figure 1:
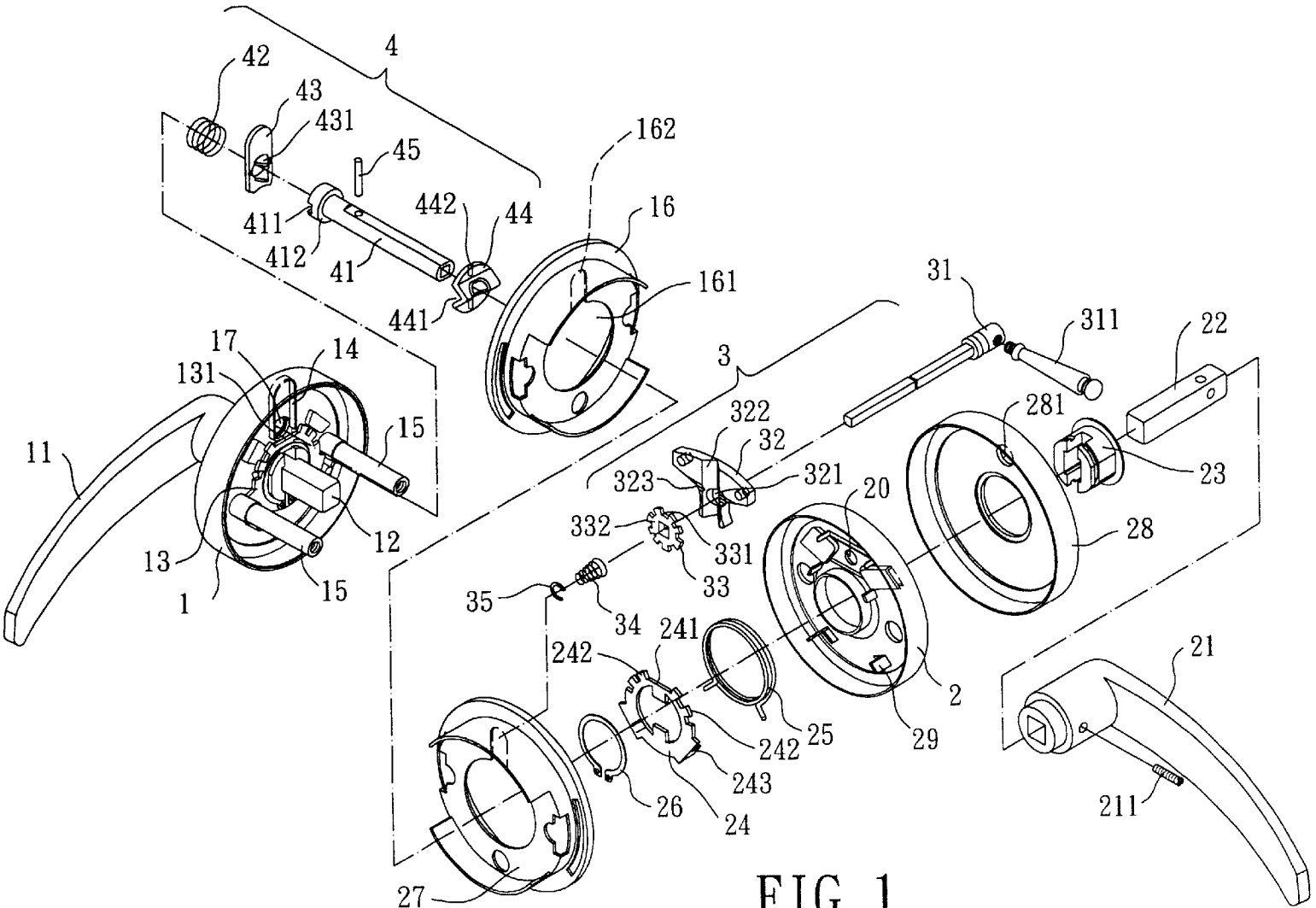
FIG. 1 is an exploded perspective view of a lock structure for bathroom use in accordance with the present invention.
Figure 2:
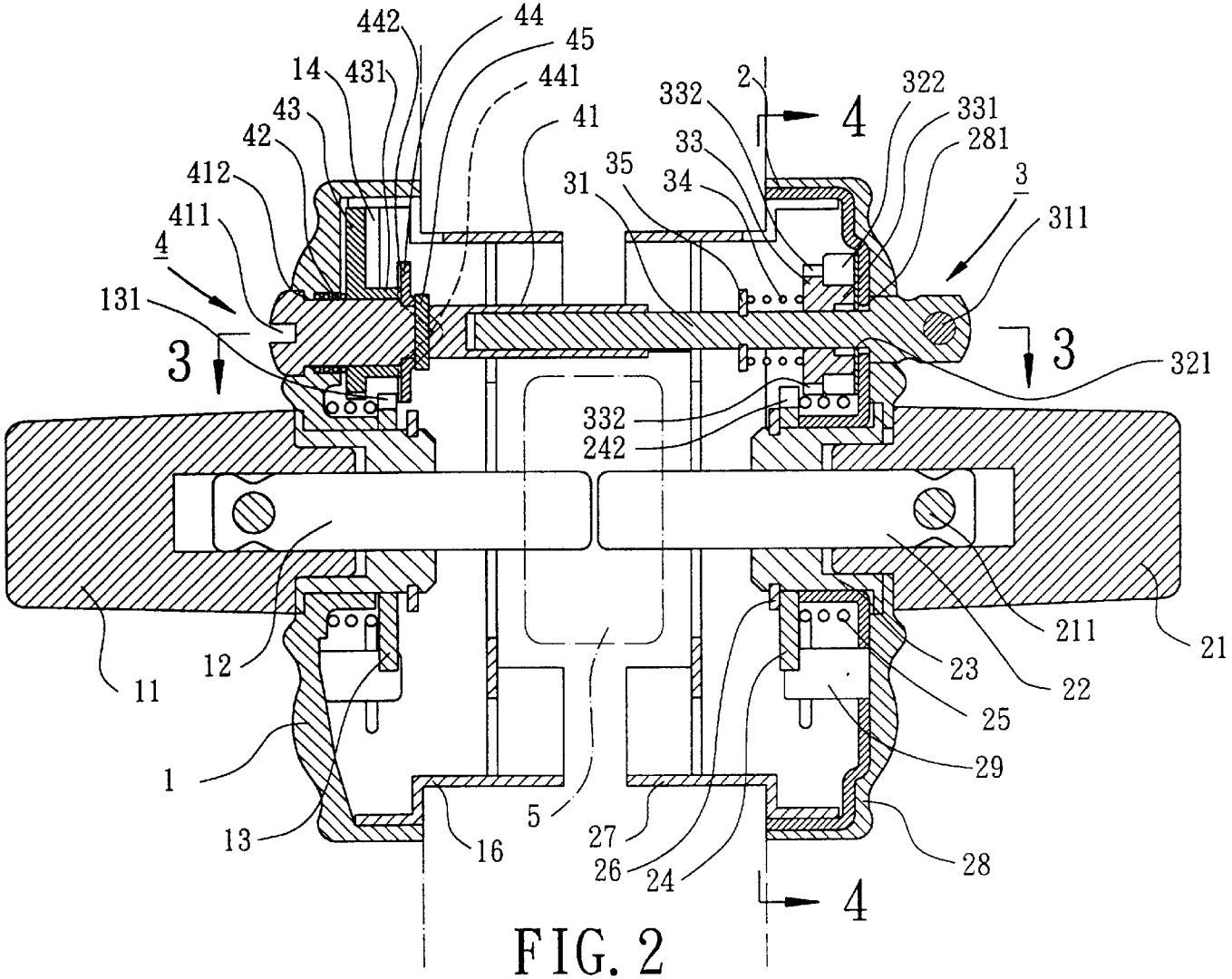
FIG. 2 is a sectional view of the lock structure in FIG. 1, wherein the lock is in an unlocked state.

Referring to FIGS. 1 and 2, a lock structure for bathroom use in accordance with the present invention generally includes an outer rose 1, an inner rose 2, an inner unlatching mechanism 3, and an outer unlatching mechanism 4.

The outer rose 1 is mounted to an outer side of a doorplate. An outer handle 11 is pivotally mounted to the outer rose 1 and engaged with an outer spindle 12 by fasteners such as bolts (not shown) that are detachable, allowing change in the orientation of the outer handle 11 relative to the outer rose 1. The outer handle 11 can be of any conventional shape and made of any suitable material. A wheel 13 is mounted on the outer spindle 12 to turn therewith. The wheel 13 includes an engaging groove 131 in a periphery thereof. Further, a pair of plates 14 project from an inner side of the outer rose 1. Two posts 15 extend from the outer rose 1 into an inner side of the doorplate. An outer housing 16 is attached to the inner side of the outer rose 1 and includes a hole 161 through which the outer spindle 12 extends and a slot 162 through which an outer unlatching rod 41 of the outer unlatching mechanism 4 extends.

The inner rose 2 is engaged with the outer rose 1 by means of extending fasteners such as bolts (not shown) through the inner rose 2 into screw holes (not labeled) of the posts 15 of the outer rose 1. Thus, the inner rose 2 and the outer rose 1 are respectively mounted to the inner side and the outer side of the doorplate. An inner handle 21 is pivotally mounted to the outer rose 1 and engaged with an inner spindle 22 by fasteners such as bolts 211 that are detachable, allowing change in the orientation of the inner handle 21 relative to the outer rose 1. Namely, the inner handle 21 can be located at 3 o'clock or 9 o'clock position. The inner spindle 22 is connected to the inner handle 21 to move therewith. A drive wheel 23 and a follower wheel 24 are mounted on the inner spindle 12 to turn therewith. A retainer ring 26 is provided to prevent disengagement of the drive wheel 23 and the follower wheel 24. The follower wheel 24 includes a notch 241 and a plurality of teeth 242 in a periphery thereof. Further, an elastic element 25 for returning the inner handle 21 is mounted in the inner rose 2 and includes a first end attached to a protrusion 243 of the follower wheel 24 and a second end attached to a protrusion 29 on the inner rose 21. The inner rose 2 is engaged with an inner housing 27. If necessary, an escutcheon 28 may be provided to enclose the inner rose 2, thereby providing an aesthetic appearance and preventing damage by a burglar.

The inner unlatching mechanism 3 includes an inner unlatching rod 31, a fixing member 32, a locking wheel 33, an elastic element 34, and a retainer 35. The inner unlatching rod 31 is pivotally extended through a hole 21 in the inner rose 2 and has an end that extends beyond a hole 281 in the escutcheon 28 and that is engaged with an arm 311. The arm 311 can be turned for turning the inner unlatching rod 31. The fixing member 32 is fixed on the inner rose 2 and includes a hole 321 through which the inner unlatching rod 31 extends. The fixing member 32 further includes a first engaging notch 322 and a second engaging notch 323 having a depth not equal to that of the first engaging notch 322. In this embodiment, the first engaging notch 322 is deeper than the second engaging notch 323 and extends in a direction perpendicular to the extending direction of the second engaging notch 323 for selective engagement with an engaging block 331 of the locking wheel 33.

The engaging block 331 projects from a side of the locking wheel 33 and is substantially triangular. Further, the locking wheel 33 includes annularly arranged teeth 332 in a periphery thereof. When the engaging block 331 is engaged in the first engaging notch 322, the locking wheel 33 is biased by the elastic element 34 such that the teeth 332 of the locking wheel 33 disengage from the teeth 242 of the follower wheel 24. When the engaging block 331 is engaged in the second engaging notch 323, the teeth 332 of the locking wheel 33 are engaged in the notch 241 of the follower wheel. Thus, when the follower wheel 24 turns, the locking wheel 33 also turns through engagement between the teeth 332 of the locking wheel 33 and the teeth 242 of the follower wheel 24. The elastic element 34 biases the locking wheel 33 such that locking wheel 33 is always in intimate contact with the fixing member 32 and that the engaging block 331 is selectively engaged in one of the first engaging notch 322 and the second engaging notch 323.

The outer unlatching mechanism 4 includes an outer unlatching rod 41, an elastic element 42, a stop plate 43, and a locking plate 44. The outer unlatching rod 41 is pivotally extended through a hole 17 of the outer rose 1 located between the plates 14 and includes an end engaged with the inner unlatching rod 31 of the inner unlatching mechanism 3 through a non-circular section. For example, the inner unlatching rod 31 is rectangular and engaged in a rectangular hole (not labeled) in the outer unlatching rod 41. The other end of the outer unlatching mechanism 41 includes a drive portion 411 that is exposed outside the outer rose 1. When in emergency, the outer unlatching rod 41 can be turned by turning the drive portion 411. The drive portion 411 may be a slot. Further, the outer unlatching rod 41 includes a stop wall 412 adjacent to the drive portion 411 and may be formed by providing an enlarged end on which the drive portion 411 is provided.

The elastic element 42, the stop plate 43, and the locking plate 44 are mounted around the outer unlatching rod 41, and a retaining member, e.g., a pin 45 is provided to retain the locking plate 44 on the outer locking plate 44. The stop plate 43 and the outer unlatching rod 41 may rotate relative to each other, but the locking plate 44 and the outer unlatching rod 41 turns jointly. In this embodiment, the outer unlatching rod 41 includes a non-circular outer periphery, and the locking plate 44 includes a non-circular hole (not labeled) through which the outer unlatching rod 41 extends. The stop plate 43 and the locking plate 44 are biased by the elastic element 42 such that the stop plate 43 is always in intimate contact with the locking plate 44.

The locking plate 44 includes a first engaging groove 441 and a second engaging groove 442 that is shallower than the first engaging groove 411. The stop plate 43 includes a protrusion 431. When the locking plate 44 turns together with the outer unlatching rod 41, if the protrusion 431 of the stop plate 43 is engaged in the first engaging groove 441 of the locking plate 44, the stop plate 43 is partially located between the plates 14 of the outer rose 1, and the stop plate 43 is engaged in the engaging groove 13 of the wheel 13. When the locking plate 44 turns together with the outer unlatching rod 41, if the protrusion 431 of the stop plate 43 is engaged in the second engaging groove 442 of the locking plate 44, the stop plate 43 is moved toward the stop wall 412 until it is thoroughly received between the plates 14 of the outer rose 1 and misaligned with (i.e., disengaged from) the engaging groove 131 of the wheel 13.

Figure 3:
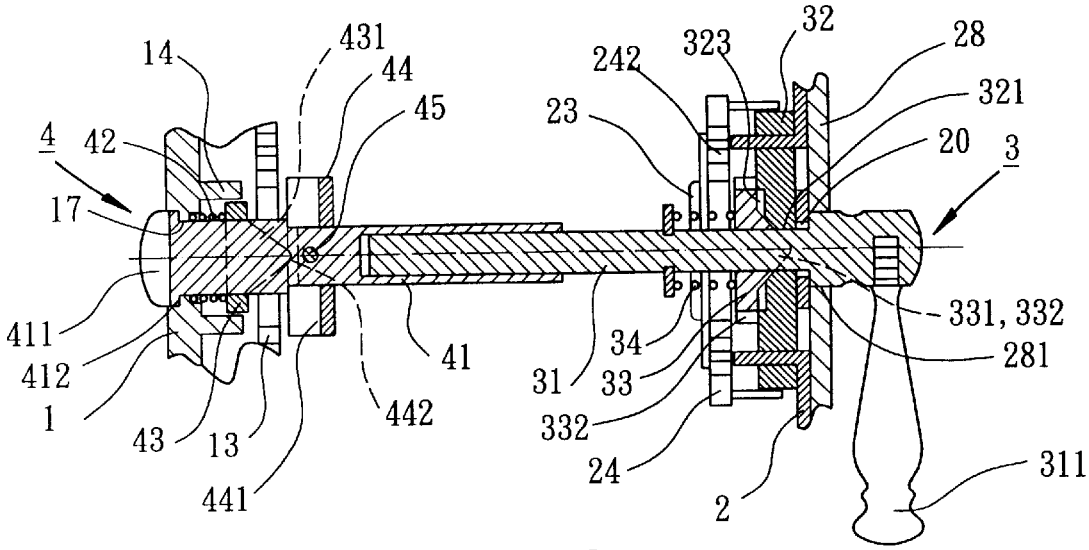
FIG. 3 is a sectional view taken along plane 3—3 in FIG. 2.
Figure 4:
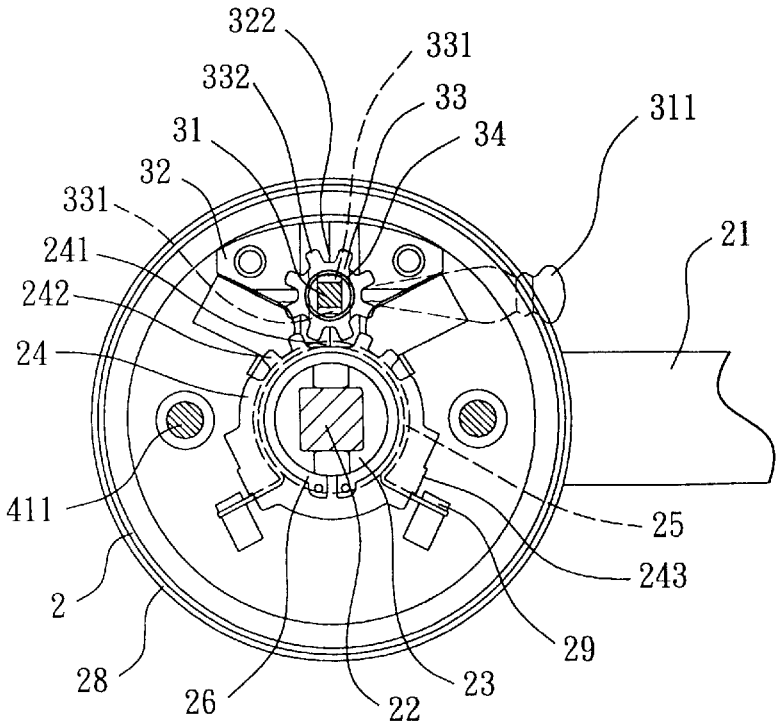
FIG. 4 is a sectional view taken along plane 4—4 in FIG. 2.

FIGS. 2 through 4 illustrate the lock in an unlocked state, wherein the locking wheel 33 of the inner unlatching mechanism 3 is biased by the elastic element 34 such that the engaging block 331 of the locking wheel 33 enters the deeper first engaging notch 322 of the fixing member 32. Thus, the locking wheel 33 is not aligned with the notch 241 of the follower wheel 24 of the inner rose 2, and the protrusion 431 of the stop plate 43 is engaged with and thus retained in place by the second engaging groove 442 of the locking plate 44. As a result, the stop plate 43 is thoroughly received between the plates 14 of the outer rose 1 such that the stop plate 43 is not aligned with (i.e., disengaged from) the engaging groove 131 of the wheel 13. In this case, when either handle 21, 11 is turned, the associated inner spindle 22 or outer spindle 12 is turned for retracting the latch bolt of the latch mechanism 5. Namely, the doorplate of the bathroom can be opened normally.

Figure 5:
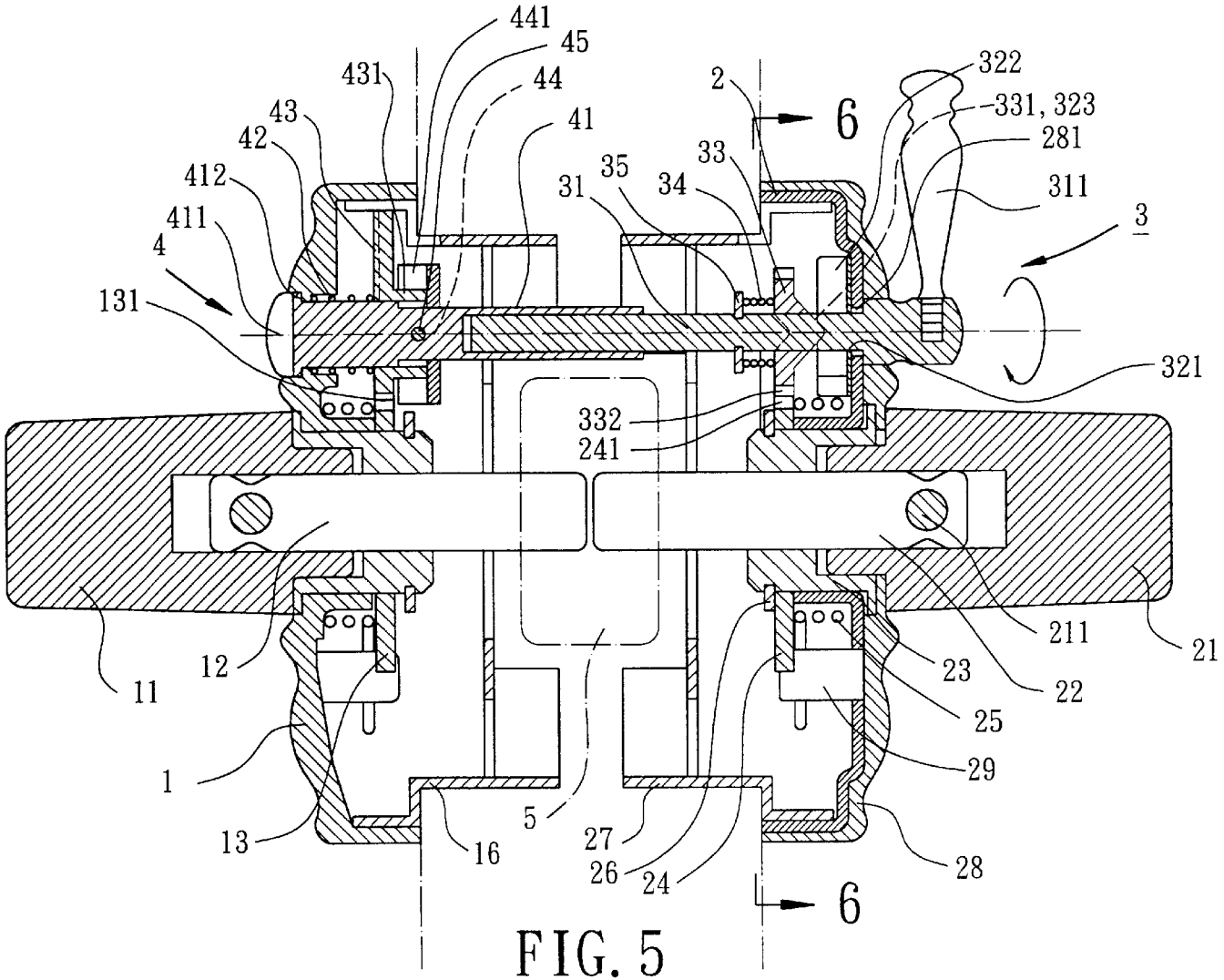
FIG. 5 is a view similar to FIG. 2, wherein the lock is in a locked state.
Figure 6:
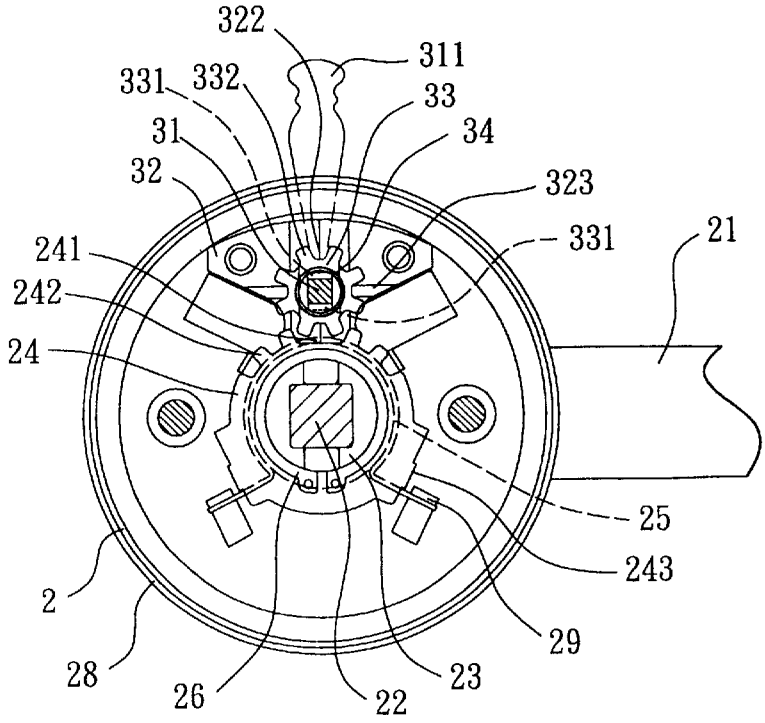
FIG. 6 is a sectional view taken along plane 6—6 in FIG. 5.

FIGS. 5 and 6 illustrate the lock in a locked state. In this case, the arm 311 of the inner unlatching mechanism 3 can be turned for turning the inner unlatching rod 31 and the locking wheel 33. The engaging block 331 of the locking wheel 33 is engaged with and thus positioned by the second engaging notch 323 of the fixing member 32. Since the second engaging notch 323 is shallower than the first engaging notch 322, the locking wheel 33 enters the notch 241 of the follower wheel 24. Further, the outer unlatching rod 41 of the outer unlatching mechanism 4 is also turned when the inner unlatching rod 41 is turned, and the locking plate 44 turns accordingly. In this case, the stop plate 43 is biased by the elastic element 42 such that the protrusion 431 of the stop plate 43 is engaged in the first engaging groove 441 of the locking plate 44. As a result, the stop plate 43 is partially located between the plates 14 of the outer rose 1, and the stop plate 43 enters the engaging groove 131 of the wheel 13. At this time, when the outer handle 11 is turned, since the stop plate 43 is engaged in the engaging groove 131 of the wheel 13 that may rotate together with the outer spindle 12 and since the stop plate 43 is partially hidden between the plates 41, the stop plate 43 could not be turned, and the unlatching operation by means of turning the outer handle 11 fails. Namely, the lock is still in the locked state.

Figure 7:
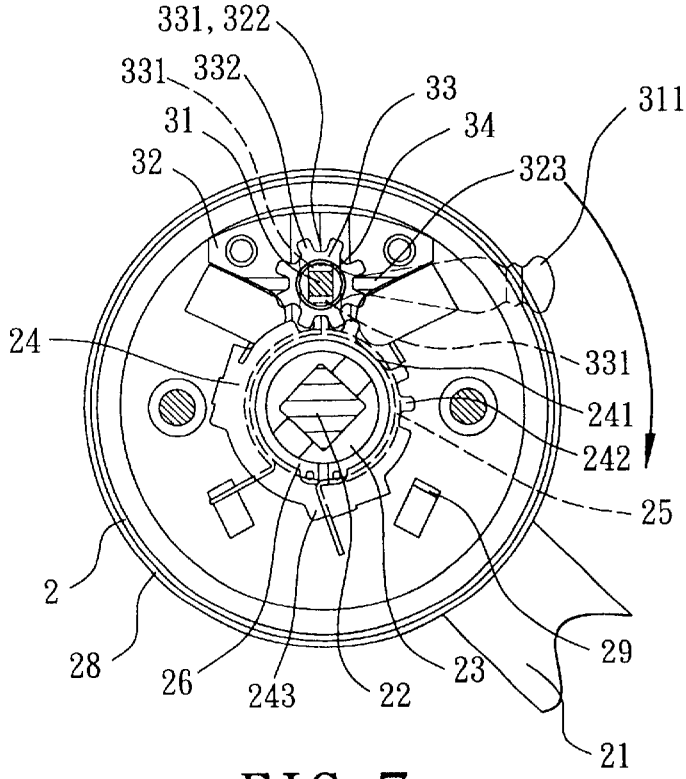
FIG. 7 is a view similar to FIG. 6, illustrating unlocking operation.
Figure 8:
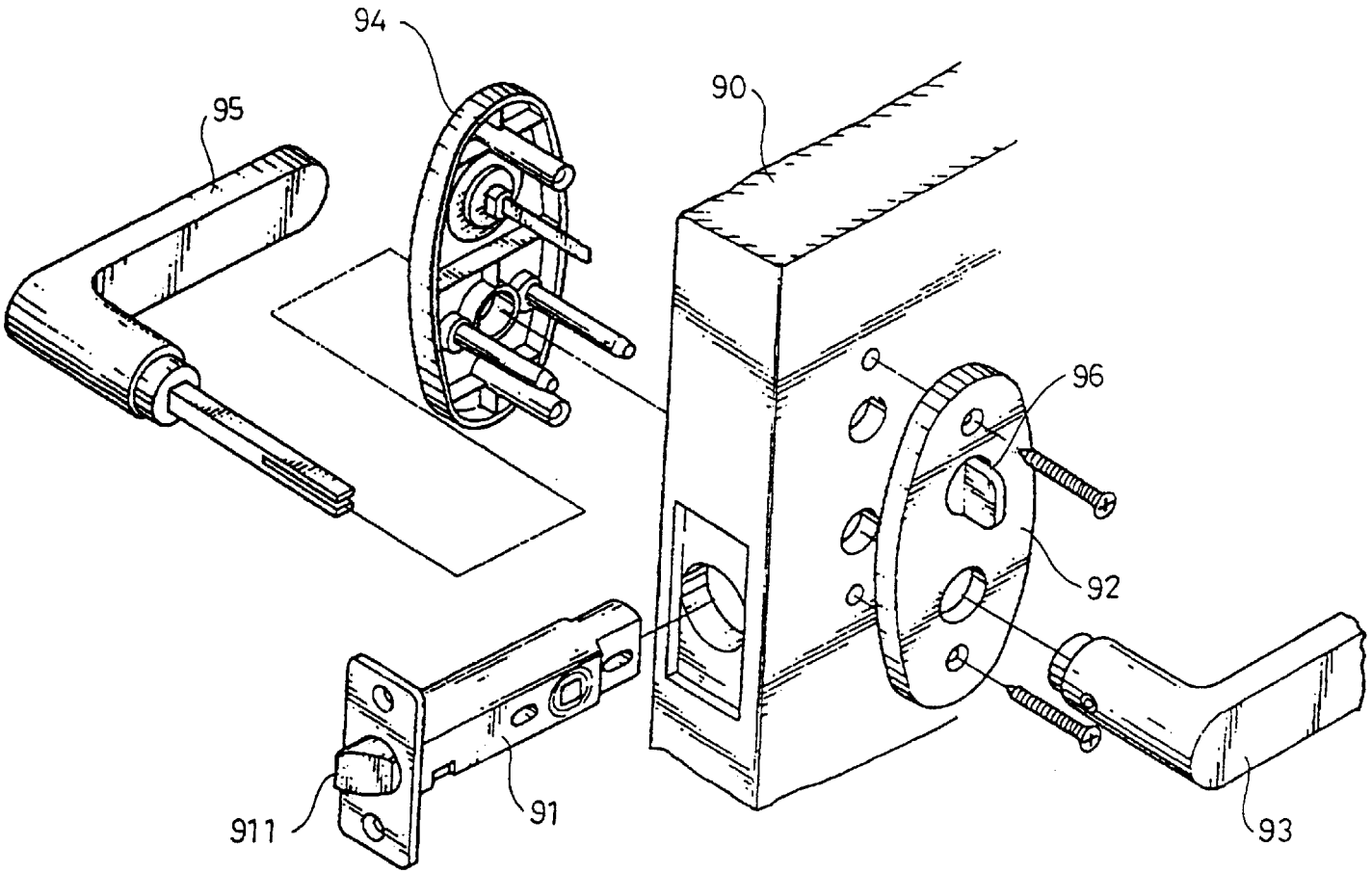
FIG. 8 PRIOR ART
FIG. 8 is an exploded perspective view of a conventional lock structure for bathroom use.
Figure 9:
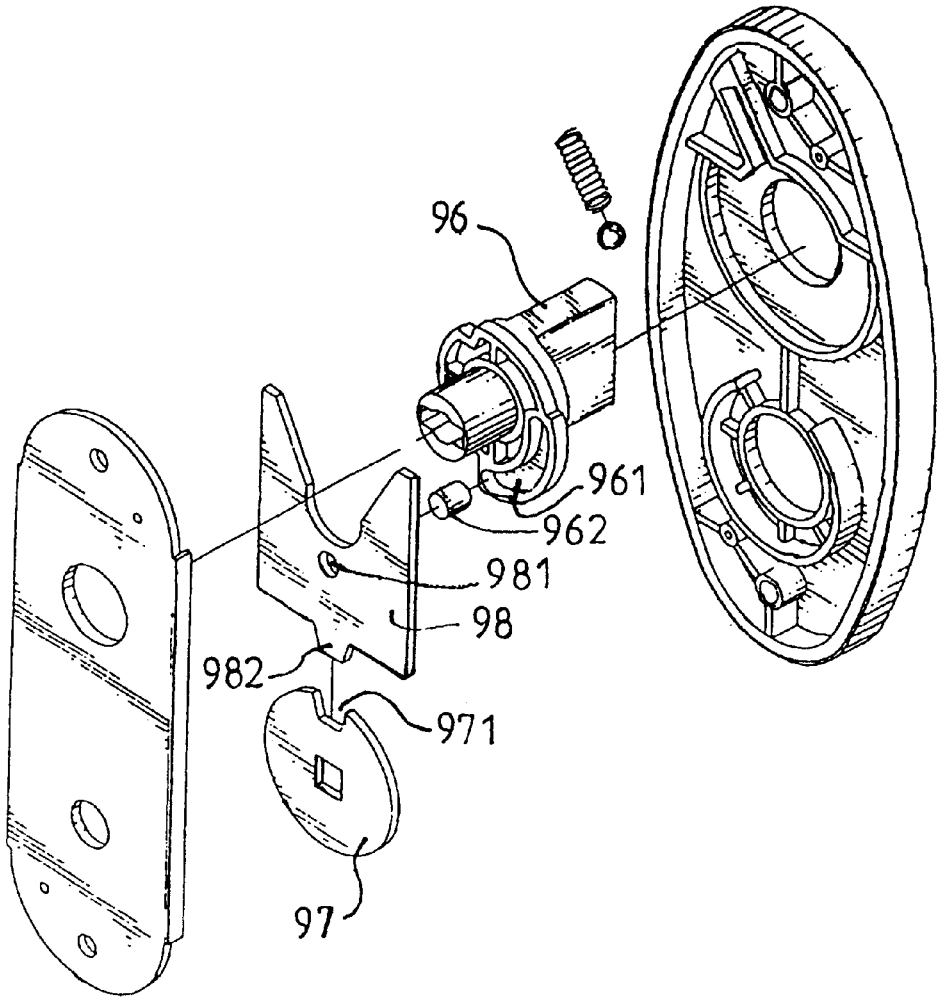
FIG. 9 PRIOR ART
FIG. 9 is an exploded perspective view illustrating detailed structure in an inner rose of the conventional lock structure in FIG. 8.

Referring to FIG. 7, when the lock is in the locked state, unlatching operation can be achieved from inside by means of directly turning the inner handle 21 without the need of unlatching the inner unlatching mechanism 3. The inner spindle 22 is turned for retracting the latch bolt of the latch mechanism 5. When in the locked state, the locking wheel 33 is engaged in the notch 241 of the follower wheel 24 such that when the inner spindle 22 turns, the follower wheel 24 also turns, which, in turn, causes rotation of the locking wheel 33 through the teeth 242 of the follower wheel 24. Since the locking wheel 33 and the inner unlatching rod 31 turns jointly, the inner unlatching rod 31 cause simultaneous rotation of the outer unlatching rod 41. As a result, the locking plate 44 on the outer unlatching rod 41 turns relative to the stop plate 43. The protrusion 431 of the stop plate 43 is disengaged from the first engaging groove 441 of the locking plate 44 and then engaged in the second engaging groove 442. The stop plate 43 is thus moved into the plates 14 and disengaged from the engaging groove 131 of the wheel 13. The lock is unlatched accordingly.

Referring to FIG. 5 again, when the lock in the locked state, when emergency unlatching is required, the user may use a coin to engage with the drive portion 411 in the form of a slot and then turn the outer unlatching rod 41. The locking plate 44 is turned, and the protrusion 431 of the stop plate 43 enters the second engaging groove 442 of the locking plate 44, causing the stop plate 43 to move thoroughly into the space between the plates 14 and to disengage from with the engaging groove 131 of the wheel 13. Thus, the lock is unlatched, and the door can be then opened by means of turning the outer handle 11 in which the latch bolt 5 of the latch mechanism is retracted by turning the outer spindle 12.

The lock structure for bathroom use in accordance with the present invention allows easy interchange of the position of the inner handle 21 and the outer handle 11 relative to the inner rose 2 and the outer rose 1. Thus, the lock can be used with either a left-handed door or a right-handed door. Further, when the locked in the locked state, unlatching of the lock can be achieved by means of directly turning the inner handle 21 without the troublesome unlatching by the turn piece and the subsequent turning of the inner handle required by the conventional bathroom lock. Thus, unlatching is very easy, which is very useful when in emergency.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A lock structure for bathroom use, the lock structure comprising:

an outer rose (1), an outer handle (11) being pivotally mounted to the outer rose (1), an outer spindle (12) being connected to the outer handle (11) to turn therewith, a wheel (13) being mounted to the outer spindle (12) to turn therewith, the wheel (13) including an engaging groove (131), a pair of plates (14) being formed on the outer rose (1), a hole (17) being defined between the plates (14);

an inner rose (2), an inner handle (21) being pivotally mounted to the inner rose (2), an inner spindle (22) being connected to the inner handle (21) to turn therewith, a drive wheel (23) and a follower wheel (24) being mounted on the inner-spindle (22) to turn therewith, an elastic element (21) being mounted on the inner spindle (22) for returning the inner handle (21), the follower wheel (24) including a notch (241), the inner rose (2) further including a hole (20);

an inner unlatching mechanism (3) including an inner unlatching rod (31), a fixing member (32), and a locking wheel (33), the inner unlatching rod (31) being pivotally extended through the hole (20) of the inner rose (2), the fixing member (32) being fixed in the inner rose (2) and including a hole (321) through which the inner unlatching rod (31) extends, the fixing member (32) further including a first engaging notch (322) and a second engaging notch (323) shallower than the first engaging notch (322), the locking wheel (33) being mounted on the inner unlatching rod (31) to turn therewith, the locking wheel (33) including an engaging block (331) and a plurality of teeth (332), wherein when the engaging block (331) is engaged in the first engaging notch (322) of the fixing member (32), the locking wheel (33) is disengaged from the follower wheel (24), and wherein when the engaging block (331) is engaged in the second engaging notch (322) of the fixing member (32), the locking wheel (33) is engaged in the notch (241) of the follower wheel (24); and an outer unlatching mechanism (4) including an outer unlatching rod (41), an elastic element (42), a stop plate (43), and a locking plate (44), the outer unlatching rod (41) being pivotally extended through the hole (17) of the outer rose (1) and including a first end securely engaged with the inner unlatching rod (31) of the inner unlatching mechanism (3), the outer unlatching rod (41) further including a second end that is exposed outside the outer rose (1) and that has a drive portion (411), the locking plate (44) being mounted on the outer unlatching rod (41) to turn therewith, the stop plate (43) being mounted on the outer unlatching rod (41) and rotatable relative to the locking plate (44), the locking plate (44) including a first engaging groove (441) and a second engaging groove (442) shallower than the first engaging groove (441), the stop plate (43) including a protrusion (431) and being biased by the elastic element (42) of the outer unlatching mechanism (4) to be selectively engaged in one of the first engaging groove (441) and the second engaging groove (442) of the locking plate (44), wherein when the protrusion (431) of the stop plate (43) is engaged in the first engaging groove (441) of the locking plate (44), the stop plate (43) is partially located between the plates (14) on the outer rose (1) and engaged in the engaging groove (131) of the wheel (13), and wherein when the protrusion (431) of the stop plate (43) is engaged in the second engaging groove (442) of the locking plate (44), the stop plate (43) is received between the plates (14) on the outer rose (1) and disengaged from the engaging groove (131) of the wheel (13).

2. The lock structure for bathroom use as claimed in claim 1, wherein the inner spindle (22) is connected to the inner handle (21) by detachable fasteners, and wherein the outer spindle (12) is connected to the outer handle (11) by detachable fasteners.

3. The lock structure for bathroom use as claimed in claim 1, further comprising an outer housing (16) secured to the outer rose (1).

4. The lock structure for bathroom use as claimed in claim 1, further comprising an inner housing (27) secured to the inner rose (2).

5. The lock structure for bathroom use as claimed in claim 1, wherein the inner unlatching rod (31) further includes another elastic element (34) for biasing the locking wheel (33) such that the engaging block (331) of the locking wheel (33) is always in intimate contact with the fixing member (32).

6. The lock structure for bathroom use as claimed in claim 1, wherein the outer unlatching rod (41) is mounted around the inner unlatching rod (31).

7. The lock structure for bathroom use as claimed in claim 1, wherein the elastic element (42) mounted on the outer unlatching rod (41) biases the stop plate (43) to be always in intimate contact with the locking plate (44).

* * * * *